US006068318A

United States Patent [19]

Freund

[11] Patent Number: 6,068,318

[45] Date of Patent: May 30, 2000

[54] CLAMP FOR CONVEYOR BELTS

[76] Inventor: Leslie John Freund, 12 Mariner Crescent, Abbortsbury, New South Wales, Australia, 2176

[21] Appl. No.: 09/177,720

[22] Filed: Oct. 23, 1998

[30] Foreign Application Priority Data

Oct. 27, 1997 [AU] Australia ..... 89466/98

[51] Int. Cl.[7] ..... B25B 25/00

[52] U.S. Cl. ..... 294/103.1; 294/134; 254/199

[58] Field of Search ..... 294/132–136, 294/102.1, 103.1, 67.33, 81.54, 81.62; 254/199; 269/246, 247, 249, 250

[56] References Cited

U.S. PATENT DOCUMENTS

| | | | |
|---|---|---|---|
| 938,564 | 11/1909 | Fisher | 294/134 |
| 1,056,287 | 3/1913 | Lockridge | 294/134 |
| 1,095,025 | 4/1914 | Persons | 294/134 |
| 2,636,770 | 4/1953 | Cornwell | 294/103.1 |
| 5,255,950 | 10/1993 | Davies | 294/103.1 |
| 5,725,269 | 3/1998 | Daniels et al. | 294/103.1 |

*Primary Examiner*—Dean J. Kramer
*Attorney, Agent, or Firm*—Jacobson & Johnson

[57] ABSTRACT

There is a clamp for a conveyor belt. The clamp comprises a yoke having a shoulder member, two laterally extending arms defining a recess therebetween and a channel which extends through the yoke at a right angle to the width of the recess. In use of the clamp an edge portion of the belt is located in the recess and a pair of beams are inserted through the channel to pass respectively over and under the belt and rotation of a turn-screw extending through a threaded seat in one of the arms exerts a clamping force through the beams directly onto the edge portion of the belt.

7 Claims, 3 Drawing Sheets

CLAMP FOR CONVEYOR BELTS

FIELD OF THE INVENTION

This invention relates to apparatus for servicing machinery. More particularly although not exclusively it discloses an improved clamp for conveyor belts.

DESCRIPTION OF THE PRIOR ART

Conveyor belts of up to hundreds of meters in length are used in many industries including for example mining, steel and brick manufacturing and power generation. When servicing such plant it is often necessary to cut the belt so that it can be varied in length or have damaged sections replaced. When doing this the free ends are securely clamped so that they can be anchored in place or pulled to a new position as required before splicing. With large conveyors the force that must be held by the clamps may be well over a tonne. While there are a number of mechanical clamps currently available for this purpose these tend to be limited to specific belt widths, expensive to manufacture or are limited in clamping pressure due to the primary gripping forces being applied outside the belt width.

SUMMARY OF THE INVENTION

It is therefore an object of this invention to ameliorate the aforementioned disadvantages and accordingly a clamp for a conveyor belt is disclosed, said clamp including a yoke which comprises a shoulder member, two laterally extending arms defining a recess therebetween and a channel extending through said yoke at right angles to the width of said recess, whereby in use of said clamp an edge portion of said belt is located in said recess and a pair of beams are inserted through said channel to pass respectively over and under said belt and compression means associated with at least one of said arms which is adapted to exert a clamping force through said beams directly onto the edge portion of said belt.

Preferably a pair of clamps are used which are disposed one each on opposite edges of said conveyor belt with a common set of beams passing across said belt and through said clamps.

BRIEF DESCRIPTION OF THE DRAWINGS

One currently preferred form of this invention will now be described with reference to the attached illustrations in which.

DETAILED DESCRIPTION OF THE PREFERRED EMBODIMENT

Figure 2:
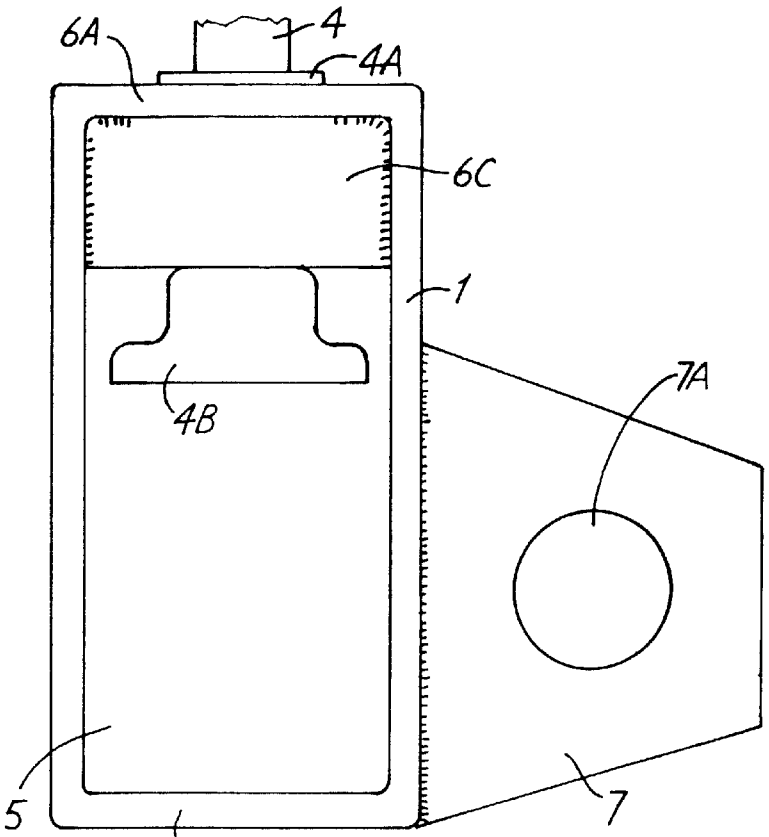
FIGS. 1 and 2 are side and end elevation views of a clamp according to this concept.
Figure 1:
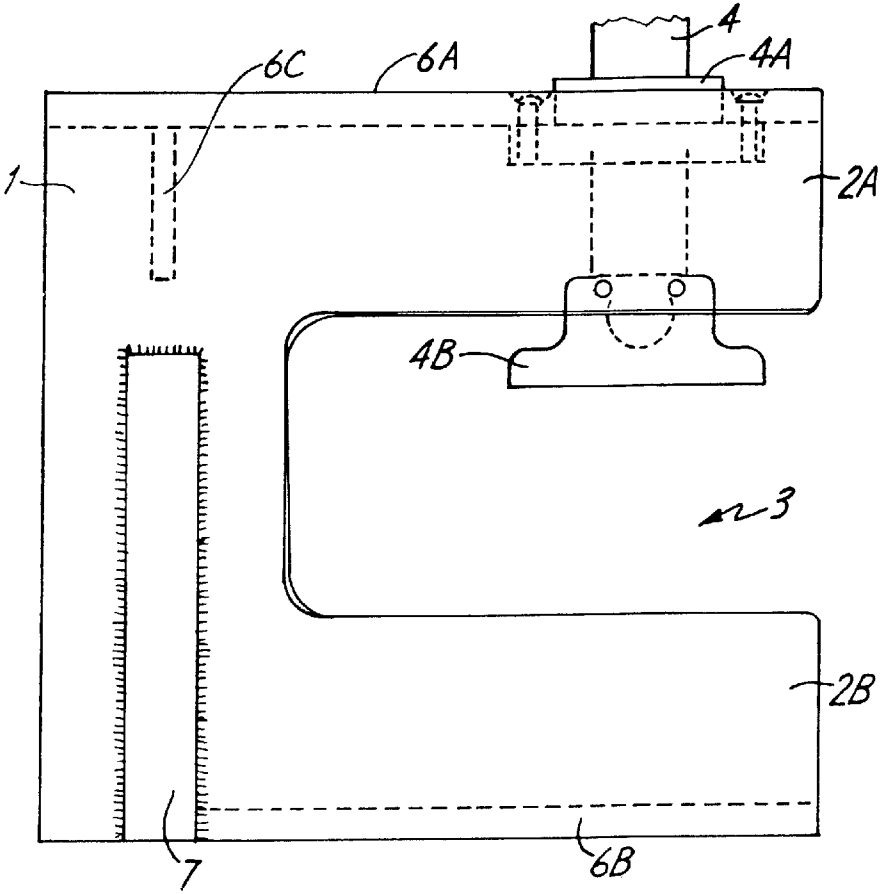

Referring first to FIGS. 1 and 2 the clamp may comprise a yoke having a shoulder member 1 and two laterally extending arms 2A and 2B. These arms define a recess 3 between them. The upper arm 2A is fitted with a turn-screw 4 which extends down through a threaded seat 4A in said arm and terminates at a foot 4B. Rotation of this screw 4 in the seat 4A moves the foot 4B either upward or downward into the recess 3.

As shown in FIG. 2 there is a channel 5 which extends through the shoulder member 1 and along the length of the arms 2A, 2B. The top and bottom of this channel are defined by walls 6A and 6B which also extend through into the arms. A strengthening gusset 6C may be welded across the upper portion of the channel. Connection for a winch or anchorage means may be in the form of a flange 7 with aperture 7A which extends out to one side of the shoulder member as shown in FIG. 2. Alternatively a U shaped bar 8 may be welded to the outside of the shoulder member as shown in FIG. 3.

Figure 3:
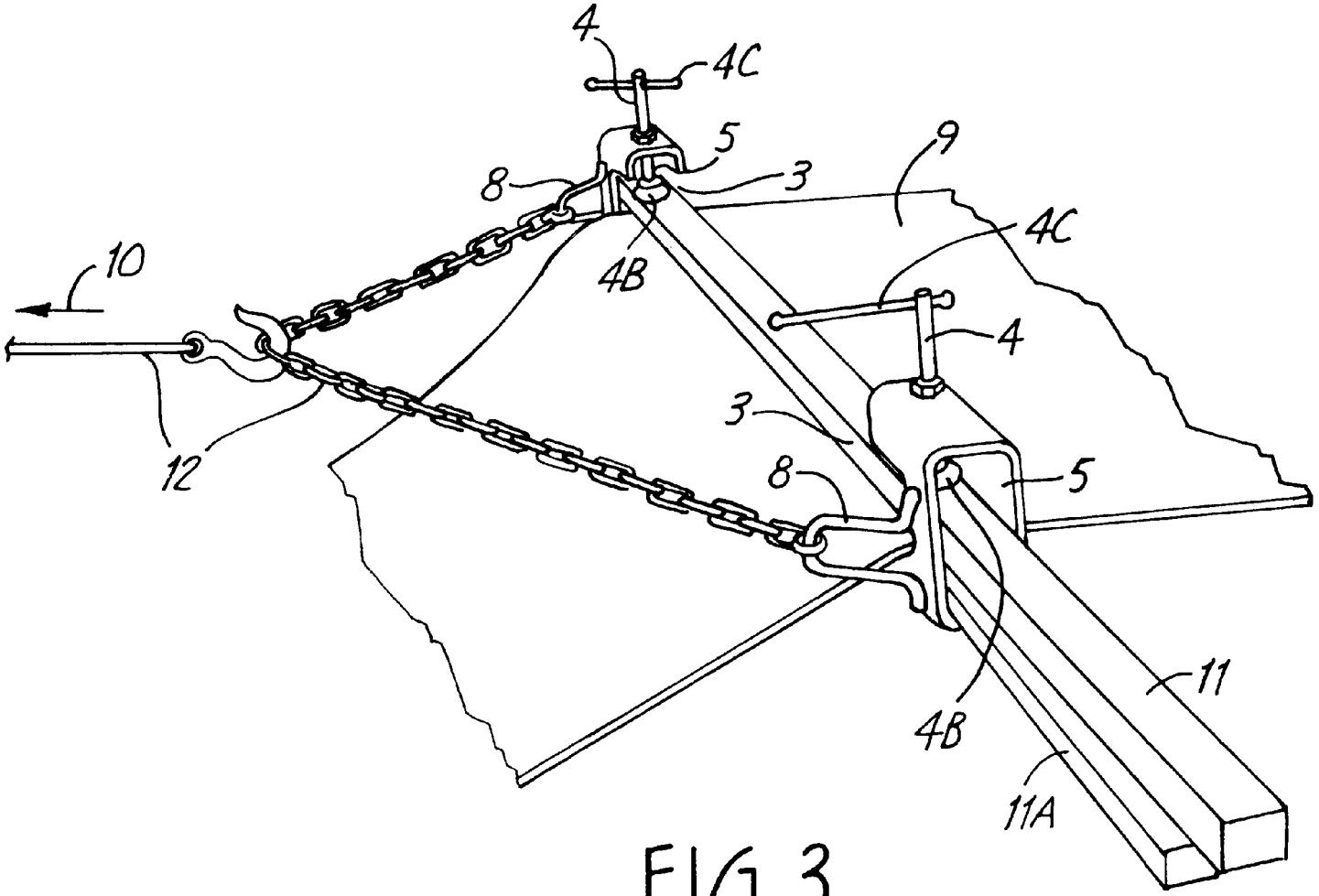
FIG. 3 is a perspective view of two such clamps in use on a conveyor belt.

FIG. 3 illustrates a section of conveyor belt 9 which is anchored or pulled in direction of arrow 10 by fitting a pair of clamps according to this invention—one to each side. The belt is sandwiched between two beams 11, 11A which extend completely through the aforementioned channels 5 of each clamp. The clamps are positioned so that the edge portions of the belt 9 extend into the recesses 3 and thus lie directly under the turnscrew feet 4B. Subsequent turning down of the screws 4 using the crank pins 4C exerts a substantial clamping force onto the beams and the belt sandwiched between them. While the maximum primary clamping force would be concentrated directly under the turn-screws 4 on each edge portion additional secondary clamping would also take place along the length of the two beams extending right across the width of the belt.

Once clamped the belt 9 may be held stationary or pulled to a new position as required by means of a chain 12 and winch apparatus attached between the U shaped bars 8. The type of winch apparatus required would be known to a person skilled in the art and thus will not be shown or described in detail. In large conveyor installations however a winch capacity of up to a tonne or more may be required.

Figure 4:
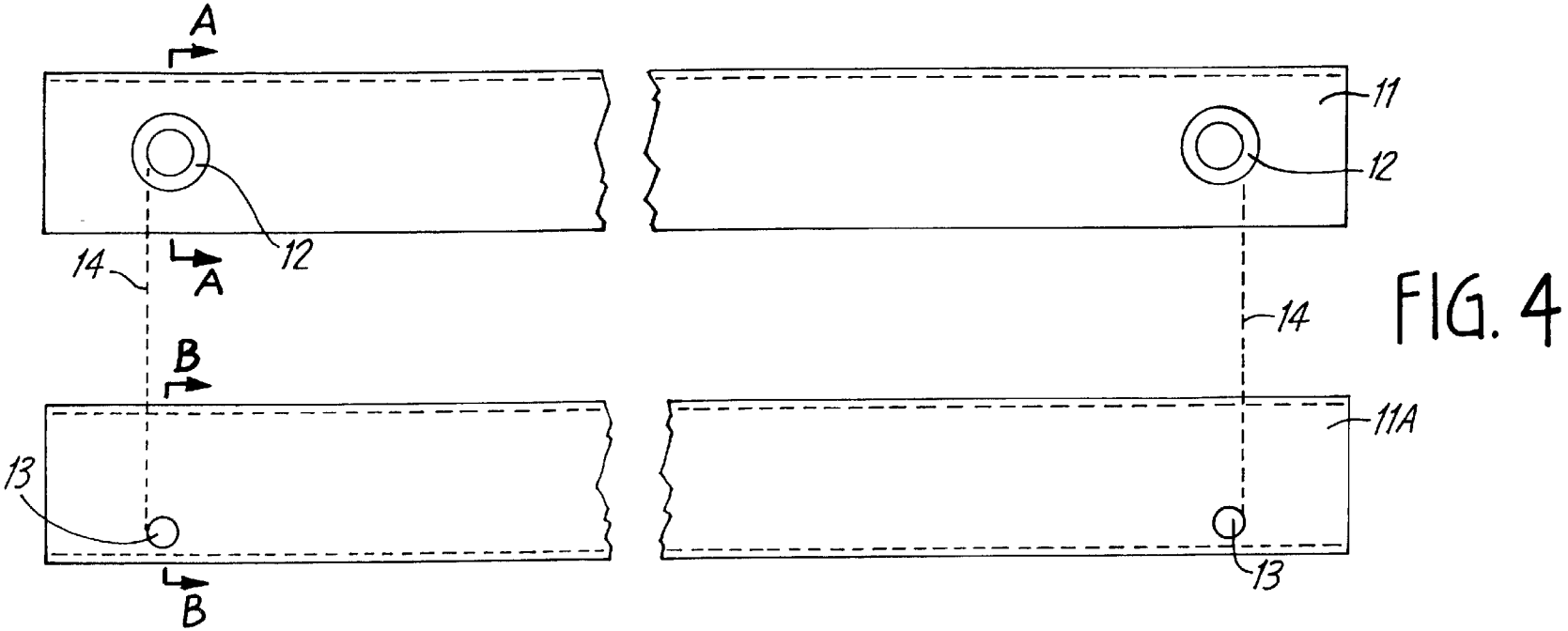
FIG. 4 shows an apparatus for pulling the two beams together prior to fitting the clamps when used on troughed belts.
Figure 6:
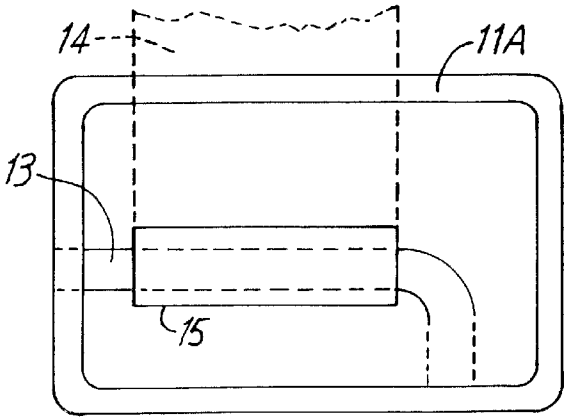
FIG. 6 shows a section along the lines B—B of FIG. 4.
Figure 5:
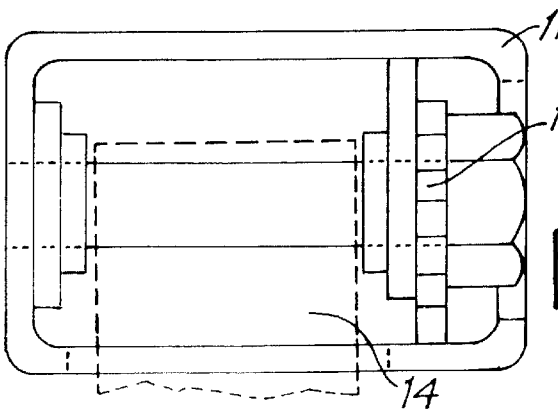
FIG. 5 shows a section along the lines A—A of FIG. 4.

When the beams 11 and 11A are fitted to a belt in a troughed position it is first necessary to draw them together before the clamps can be fitted. With large heavy belts this can be difficult to do manually. In another aspect however this invention also discloses an apparatus as shown in FIGS. 4 to 6 for drawing the beams together. The upper and lower beams may be fitted respectively with rachet and spool mechanisms 12 and anchor bars 13 adjacent the ends thereof. A length of nylon strap or webbing or other suitable material 14 extends between these fittings. After the beams are positioned and the hooks 15 on the free ends of the straps 14 engage the anchor bars 13 on the lower beam 11A as shown the rachets and spools 12 may then be cranked to draw the ends of the beams together sufficiently to to fit the clamps.

It will thus be appreciated that this invention at least in the form of the example disclosed provides a novel and improved clamping apparatus for conveyor belts. As the beams are able to extend completely through the clamps a single set of said clamps can be used for a range of different belt widths. The clamps are simply positioned along the length of the beams as required to span the belt before tightening the turn-screws. Also, as the primary clamping force is applied directly over the belt material as opposed to outside the edges as with prior art devices a much greater gripping action is obtained. This gripping force can also be selectively eased by limited unscrewing of the clamps to allowed controlled slippage of the belt. This feature which is desirable in some instances is not possible with many prior art devices. Clearly however the embodiment described is only the currently preferred form of this invention and a wide variety of modifications may be made. For example the shape and configuration of the clamps may be changed according to application or design preference. Also, while it is currently preferred that the clamps be of welded steel the invention extends to the use of other suitable materials or mean of construction.

The claims defining the invention are as follows:

1. A clamp for a conveyor belt which includes a yoke having a shoulder member, two laterally extending arms defining a recess therebetween and a channel extending through said yoke along the direction of said arms to intersect said recess whereby in use of said clamp an edge portion of said belt is located in said recess and a pair of beams are inserted through said channel to pass respectively over and under said belt and compression means associated with at least one of said arms which is adapted to exert a clamping force through said beams directly onto the edge portion of said belt.

2. The clamp as claimed in claim 1 wherein a connection means for a winch or anchorage extends out to one side of said shoulder.

3. The clamp as claimed in claim 2 wherein said connection means comprises a flange with an aperture therein.

4. The clamp as claimed in claim 2 wherein said connection means comprises a U shaped bar welded to the side of said shoulder.

5. The clamp as claimed in claim 4 wherein said compression means comprises a turn-screw which extends through a threaded seat in one of said arms.

6. The clamp as claimed in claim 5 wherein said channel extends through the yoke at right angles to the width of said recess.

7. A method of clamping a conveyor belt, said method including the steps of:

providing a pair of clamps which each include a yoke having a shoulder member, two laterally extending arms defining a recess therebetween, a channel extending through said yoke along the direction of said arms to intersect said recess and a compression means associated with at least one of said arms, locating respective edge portions of said belt one each in the recesses of said clamps, inserting a pair of beams through the channels of said clamps to pass respectively over and under said belt, and operating said compression means so as to exert a clamping force through said beams directly onto the edge portions of said belt.

* * * * *